US009902194B2

(12) United States Patent
Jackson

(10) Patent No.: US 9,902,194 B2
(45) Date of Patent: Feb. 27, 2018

(54) CHALK LINE ASSEMBLIES AND METHODS OF USE

(71) Applicant: Niles Jackson, Stockton, CA (US)

(72) Inventor: Niles Jackson, Stockton, CA (US)

( * ) Notice: Subject to any disclaimer, the term of this patent is extended or adjusted under 35 U.S.C. 154(b) by 57 days.

(21) Appl. No.: 14/885,516

(22) Filed: Oct. 16, 2015

(65) Prior Publication Data

US 2016/0107478 A1 Apr. 21, 2016

Related U.S. Application Data

(60) Provisional application No. 62/159,834, filed on May 11, 2015, provisional application No. 62/064,909, filed on Oct. 16, 2014.

(51) Int. Cl.
*B44D 3/38* (2006.01)

(52) U.S. Cl.
CPC ..... *B44D 3/38* (2013.01)

(58) Field of Classification Search
CPC ..... B44D 3/38
USPC ..... 33/414
See application file for complete search history.

(56) References Cited

U.S. PATENT DOCUMENTS

| | | | | | |
|---|---|---|---|---|---|
| 3,171,210 | A * | 3/1965 | Kundel | G01C 15/00 | 33/413 |
| 4,202,108 | A * | 5/1980 | Adams, Jr. | B44D 3/38 | 33/379 |
| 6,036,133 | A * | 3/2000 | Milligan | E04G 21/1825 | 242/378.4 |
| 6,044,568 | A * | 4/2000 | Raymond | B44D 3/38 | 33/1 G |
| 6,360,445 | B1 * | 3/2002 | Haas | B44D 3/38 | 33/1 LE |
| 6,964,109 | B1 * | 11/2005 | Bond | B44D 3/38 | 33/1 LE |
| 7,676,941 | B2 * | 3/2010 | Cruz | B44D 3/38 | 33/414 |
| 9,046,357 | B1 * | 6/2015 | Cayo | G01C 9/02 | |
| 2011/0258866 | A1 * | 10/2011 | Mikhaylenko | B44D 3/38 | 33/414 |
| 2016/0107478 | A1 * | 4/2016 | Jackson | B44D 3/38 | 33/414 |

* cited by examiner

*Primary Examiner* — Yaritza Guadalupe-McCall
(74) *Attorney, Agent, or Firm* — Christensen O'Connor Johnson Kindness PLLC

(57) ABSTRACT

In one embodiment of the present disclosure, a chalk line assembly includes: (a) a first marking portion for setting a first point, wherein the first marking portion has a height; (b) a second marking portion for setting a second point, wherein the second marking portion has a height; and (c) a chalk line for marking chalked straight line on a surface, the chalk line having first and second ends and a length extending for at least a portion of the distance between the first and second marking portions.

22 Claims, 14 Drawing Sheets

CHALK LINE ASSEMBLIES AND METHODS OF USE

CROSS REFERENCES TO RELATED APPLICATIONS

This application claims the benefit of U.S. Provisional Application No. 62/064,909, filed Oct. 16, 2014, and U.S. Provisional Application No. 62/159,834, filed May 11, 2015, the disclosures of which are hereby expressly incorporated by reference herein in their entirety.

BACKGROUND

A chalk line is a tool for marking long, straight lines on relatively flat surfaces, typically used in construction and carpentry. The use of a chalk line is generally more practical on these types of surfaces than making a line by hand or with a straight edge.

A "chalked" line lays straight lines by the action of stretching a taut nylon or similar string that has been coated with a loose chalk or other coating material between two points. The string is then laid out against the surface to be marked and pulled tight. The string is then snapped, causing the string to strike the surface, which then transfers its chalk coating to the surface along the straight line where it struck.

Chalk lines are typically used to mark relatively flat surfaces. However, chalk lines can also be used across irregular surfaces and surfaces with holes in them. In that regard, the chalk line will mark all points the string touches on or near the plane against which it is snapped.

Most devices for snapping chalk lines are designed for users to use with their hands. Therefore, when laying chalk lines on ground surfaces, the users must kneel down to the surface. The act of kneeling to the ground takes time and may cause fatigue and potential injury to users after repetitive actions.

Therefore, there exists a need for a chalk line assembly and a method of using such an assembly that allows a user to lay a chalk line from an upright, standing position. Upright work allows faster work, and also decreases fatigue and the risk of injury. Embodiments of the present disclosure are directed to fulfilling these and other needs.

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

In accordance with one embodiment of the present disclosure, a chalk line assembly is provided. The chalk line assembly includes: (a) a first marking portion for setting a first point, wherein the first marking portion has a height; (b) a second marking portion for setting a second point, wherein the second marking portion has a height; and (c) a chalk line for marking chalked straight line on a surface, the chalk line having first and second ends and a length extending for at least a portion of the distance between the first and second marking portions.

In accordance with another embodiment of the present disclosure, a chalk line assembly is provided. The chalk line assembly includes: (a) a sliding assembly for setting a first point, wherein the sliding assembly has a height of at least 4 feet, and wherein the sliding assembly includes a fixed portion having a first end and a second end and a sliding portion having a first end and a second end, the sliding portion in sliding relationship with the fixed portion; (b) a reel portion for setting a second point, wherein the second marking portion has a height of at least 4 feet; and (c) a chalk line having first and second ends and a length extending between the first end of the sliding portion of the sliding assembly and the first end of the reel portion, wherein the chalk line is retractably coupled to the reel portion.

In accordance with another embodiment of the present disclosure, a chalk line assembly is provided. The chalk line assembly includes: (a) reeling a length of a chalk line from a reel portion to a sliding assembly, wherein the chalk line has first and second ends and a length extending between the first and second ends, and wherein the sliding assembly includes a fixed portion and a sliding portion; (b) setting a first point for a chalk line using one of the reel portion and the sliding assembly; (c) setting a second point for the chalk line using the other of the reel portion and the sliding assembly; and (d) snapping the chalk line by sliding the sliding portion of the sliding assembly relative to the fixed portion of the sliding assembly.

In accordance with another embodiment of the present disclosure, a chalk line assembly is provided. The chalk line assembly includes: (a) an anchor portion for setting a first point, wherein the first marking portion has a height of at least 4 feet, the anchor portion including a horizontal line having a first end and a second end and a vertical line having a first end and a second end, the first ends of the horizontal line and the vertical line are coupled to the first end of the chalk line, and the second ends of horizontal line and the vertical line are connected to the anchor portion; (b) a reel portion for setting a second point, the reel portion having a first end and a second end, wherein the reel portion has a height of at least 4 feet; and (c) a chalk line having first and second ends and a length extending between for at least a portion of the distance between the first marking portion and the reel portion, wherein the chalk line is retractably coupled to the reel portion.

In accordance with another embodiment of the present disclosure, a method of marking a chalk line is provided. The method includes: (a) reeling a length of a chalk line from a reel portion, wherein the chalk line has first and second ends and for at least a portion of the distance between an anchor portion and the reel portion, wherein the anchor portion includes a horizontal line having a first end and a second end and a vertical line having a first end and a second end, the first ends of the horizontal line and the vertical line are coupled to the first end of the chalk line, and the second ends of horizontal line and the vertical line are connected to the anchor portion; (b) setting a first point for the chalk line using one of the reel portion and the anchor portion; (c) setting a second point for the chalk line using the other of the reel portion and the anchor portion; and (d) snapping the chalk line by pulling the vertical line upward and releasing the vertical line.

In any of the embodiments described herein, the first marking portion may include a sliding assembly.

In any of the embodiments described herein, the sliding assembly may include a fixed portion having a first end and a second end and a sliding portion having a first end and a second end, the sliding portion in sliding relationship with the fixed portion.

In any of the embodiments described herein, the fixed portion may include an anchor portion, and wherein the sliding portion is a slide pole surrounding the anchor portion.

In any of the embodiments described herein, the first end of the chalk line may be attached to the first end of the sliding portion of the sliding assembly.

In any of the embodiments described herein, the second marking portion may include a reel portion having a first end and a second end.

In any of the embodiments described herein, the second end of the chalk line may be attached at or near the first end of the reel portion.

In any of the embodiments described herein, the chalk line may be a retractable chalk line.

In any of the embodiments described herein, the chalk line may retract in a chalk line reel.

In any of the embodiments described herein, the chalk line reel may be coupled to the reel portion.

In any of the embodiments described herein, the chalk line reel may be a part of the reel portion.

In any of the embodiments described herein, the chalk line reel may be releasably coupled to the reel portion.

In any of the embodiments described herein, the chalk line reel may be coupled to a receiving portion on the reel portion.

In any of the embodiments described herein, the chalk line assembly may further include a horizontal line having a first end and a second end and a vertical line having a first end and a second end, the first ends of the horizontal line and the vertical line are coupled to the first end of the chalk line, and the second ends of horizontal line and the vertical line are connected to the anchor portion.

In any of the embodiments described herein, the anchor portion may have a first end and a second end.

In any of the embodiments described herein, the second end of the horizontal line may be coupled to the second end of the anchor portion.

In any of the embodiments described herein, the second end of the vertical line may be coupled to the first end of the anchor portion.

In any of the embodiments described herein, the coupling between the first ends of the horizontal line and the vertical line and the first end of the chalk line may include a pivoting link.

DESCRIPTION OF THE DRAWINGS

The foregoing aspects and many of the attendant advantages of this disclosure will become more readily appreciated by reference to the following detailed description, when taken in conjunction with the accompanying drawings, wherein.

DETAILED DESCRIPTION

The detailed description set forth below in connection with the appended drawings, where like numerals reference like elements, is intended as a description of various embodiments of the disclosed subject matter and is not intended to represent the only embodiments. Each embodiment described in this disclosure is provided merely as an example or illustration and should not be construed as preferred or advantageous over other embodiments. The illustrative examples provided herein are not intended to be exhaustive or to limit the disclosure to the precise forms disclosed. Similarly, any steps described herein may be interchangeable with other steps, or combinations of steps, in order to achieve the same or substantially similar result.

In the following description, numerous specific details are set forth in order to provide a thorough understanding of exemplary embodiments of the present disclosure. It will be apparent to one skilled in the art, however, that many embodiments of the present disclosure may be practiced without some or all of the specific details. In some instances, well-known process steps have not been described in detail in order not to unnecessarily obscure various aspects of the present disclosure. Further, it will be appreciated that embodiments of the present disclosure may employ any combination of features described herein.

Embodiments of the present disclosure are directed to chalk line assemblies and methods for snapping chalk likes on a surfaces. Referring to FIGS. 1-9, a chalk line assembly 20 designed and configured in accordance with one embodiment of the present disclosure is provided. The chalk line assembly 20 includes first and second marking portions 22 and 24 for marking first and second points on the line, and a chalk line 26 that extends between the first and second marking portions. Both the first and second marking portions 22 and 24 are configured to have a certain height, so as to be used by users standing in upright positions without requiring the users to bend to the ground. In one embodiment, the first and second marking portions 22 and 24 each have a height of at least about 4 feet.

Although shown and described as a "chalk" line assembly, the assembly may be configured for marking surfaces with a line that is marked from another marking substance besides chalk, such as ink, loose die, graphite, etc. Although described as "first" and "second" marking portions 22 and 24, the references have no relationship to the order in which the marks are set on the chalk line. In use, either of the first and second marking portions may be set as the first and second points in any order.

Figure 1:
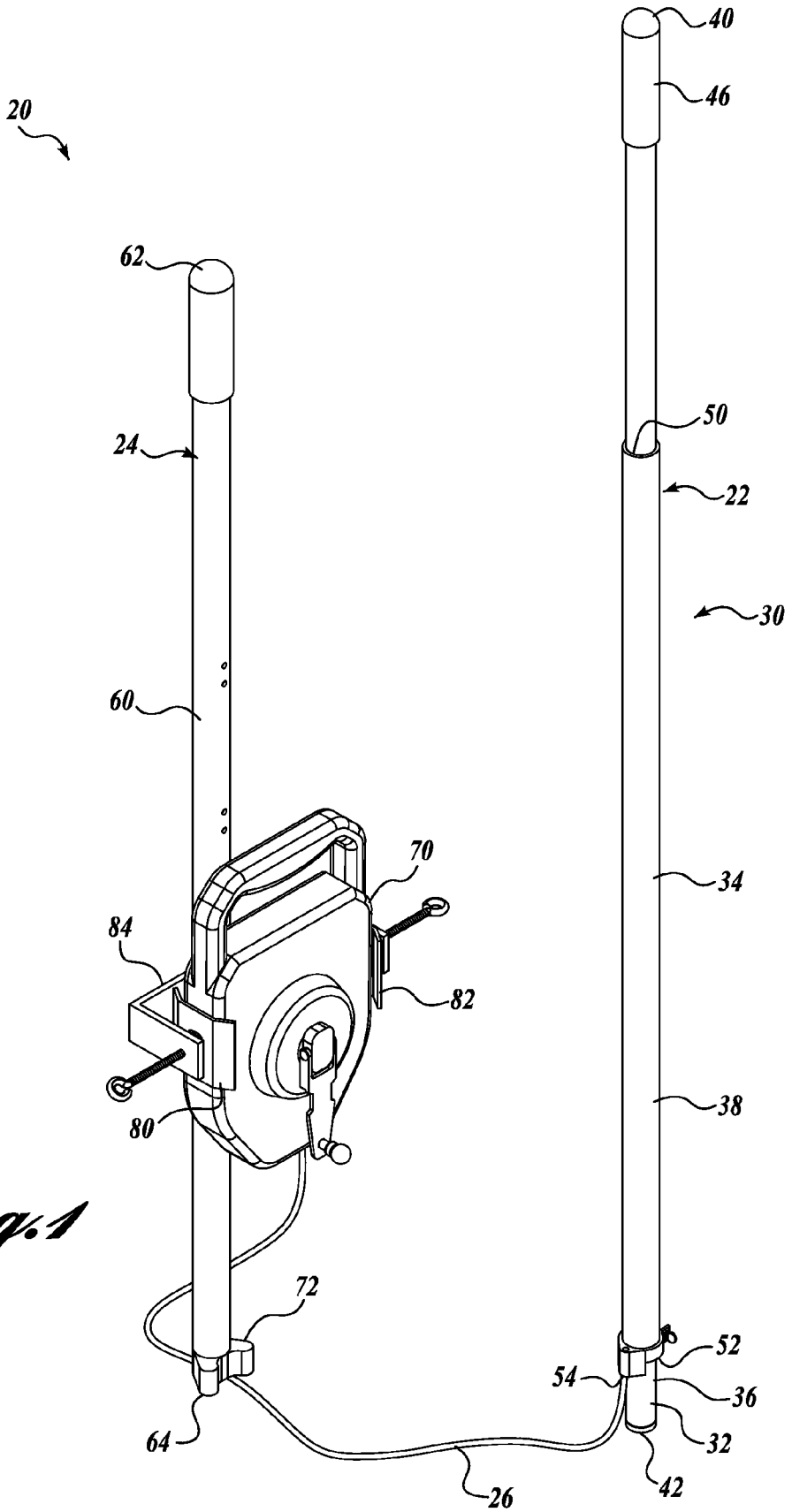
FIG. 1 is an isometric view of a chalk line assembly designed in accordance with one embodiment of the present disclosure.
Figure 2:
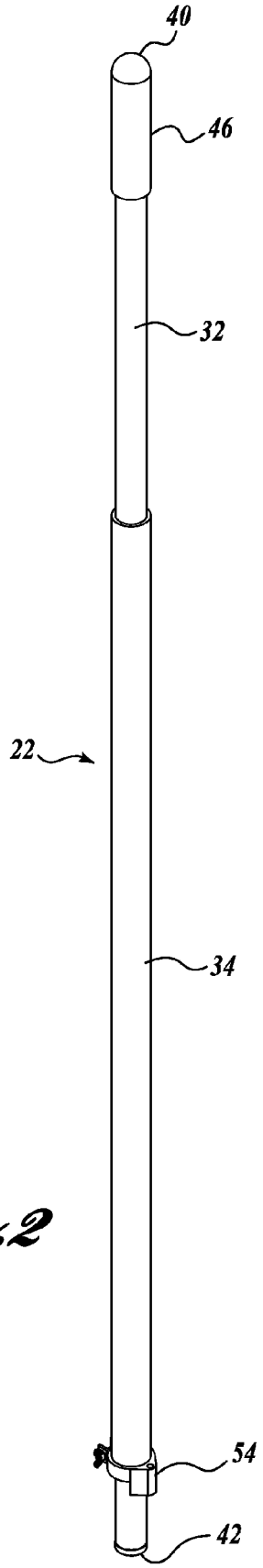
FIGS. 2 and 3 are close-up isometric views of the sliding assembly in the chalk line assembly of FIG. 1.
Figure 7:
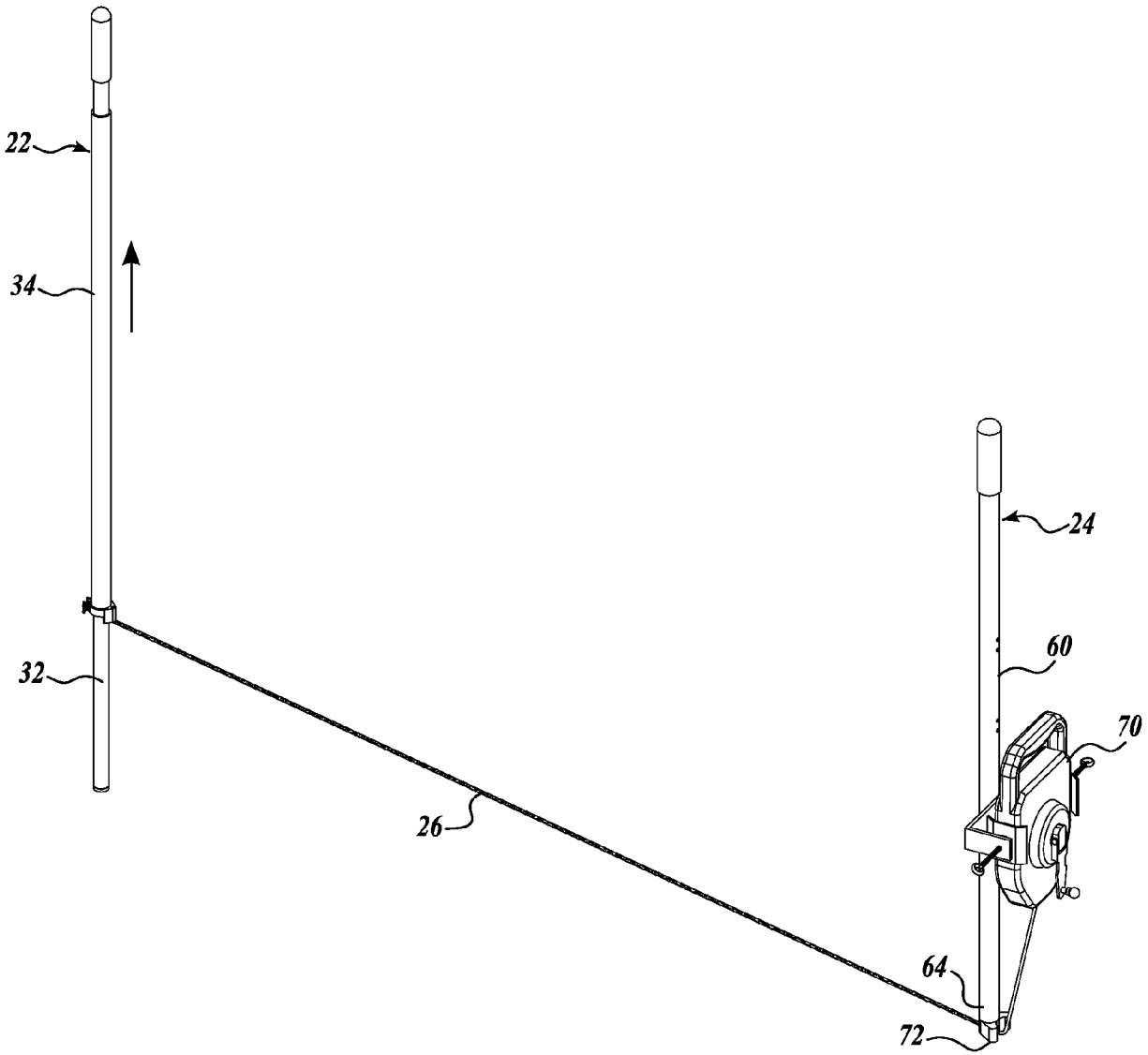
Figure 8:
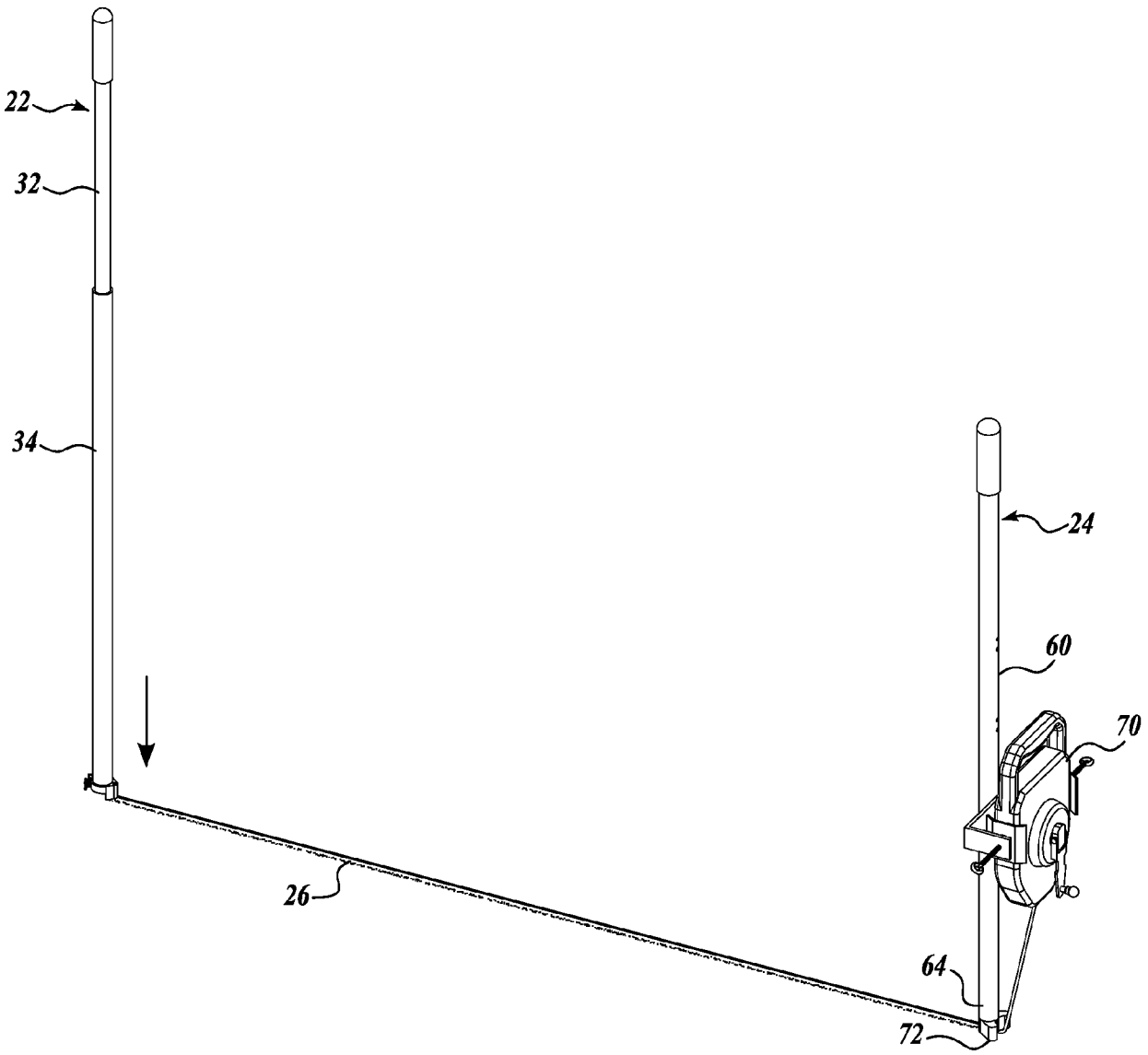
Figure 9:
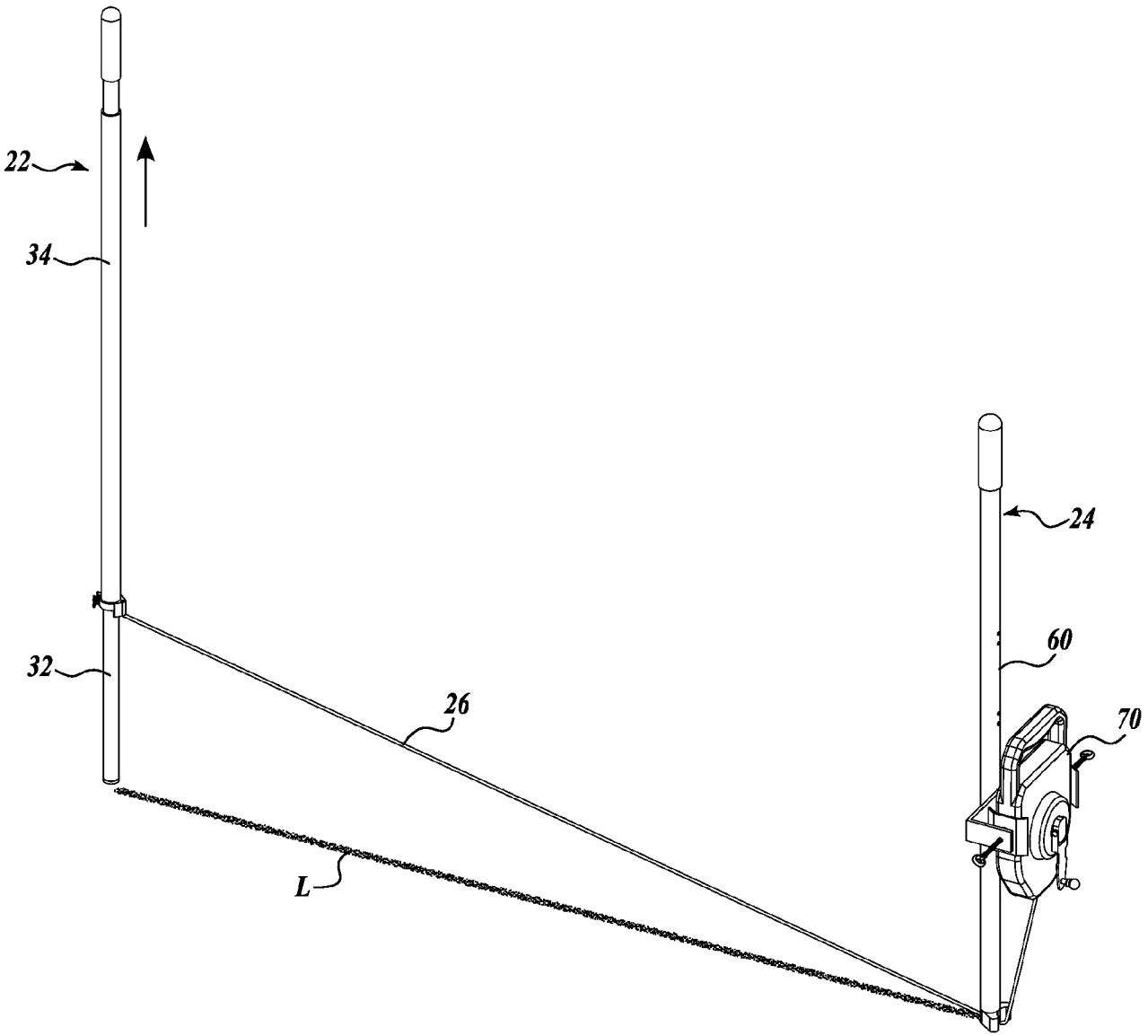

In the illustrated embodiment of FIG. 1, the first marking portion 22 includes a sliding assembly 30 having a fixed portion 32 and a sliding portion 34. As can be seen in the series of FIGS. 7-9, the sliding portion 34 is in sliding relationship with the fixed portion 32. In the illustrated embodiment, the fixed portion 32 includes an anchor portion shown as anchor pole 36 having a first end 40 and a second end 42, and the sliding portion 34 includes a slide pole 38 having a first end 50 and a second end 52, which is received for sliding movement on the anchor pole 36. In that regard, the slide pole 38 slides between a first position (see upward position in FIG. 7) at the first end 40 of the anchor pole 36 and a second position (see downward position in FIG. 8) at the second end 42 of the anchor pole 36.

Other sliding relationships between the fixed portion 32 and the sliding portion 34 are also within the scope of the present disclosure, such as a telescoping relationship or a sliding relationship along a rail. Other fixed and sliding portions besides poles are within the scope of the present disclosure.

The fixed portion 32 may include a stop 46 at the first end 40 of the anchor pole 36 so that the first end 50 of the slide pole 38 does not move past the first end 40 of the anchor pole 36 to disengage with the anchor pole 36. In the illustrated embodiment, the stop 46 is shown as a handle stop at the first end 40 of the anchor pole 36.

Figure 3:
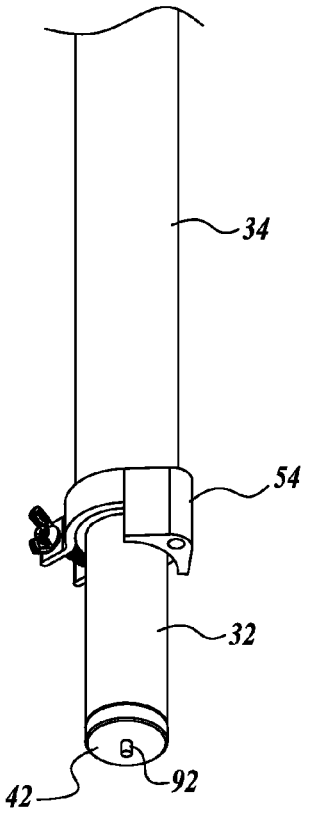

The slide pole 38 may further include an optional line bumper 54 at the second end 52 of the slide pole 38 (see close-up view in FIG. 3) for soft engagement with a surface to be marked (see slide pole 38 engagement with surface in FIG. 8). As seen in FIG. 3, the fixed portion 32 of the first marking portion 22 may include an optional pin or spike 92 at the second end 42. The spike aids in anchorage of the pole to an asphalt surface.

In the illustrated embodiment of FIG. 1, the second marking portion 24 includes a reel portion 60 having a first end 62 and a second end 64. In the illustrated embodiment, a chalk line reel 70 is attached to the reel portion 60. In the illustrated embodiment, the chalk line reel 70 includes a retractable chalk line 26 that is coated in chalk inside the reel 70.

In other embodiments of the present disclosure, the assembly may not include a chalk line reel, and may simply include a line 26 of a particular length attached to each of the first and second marking portions 22 and 24.

Figure 4:
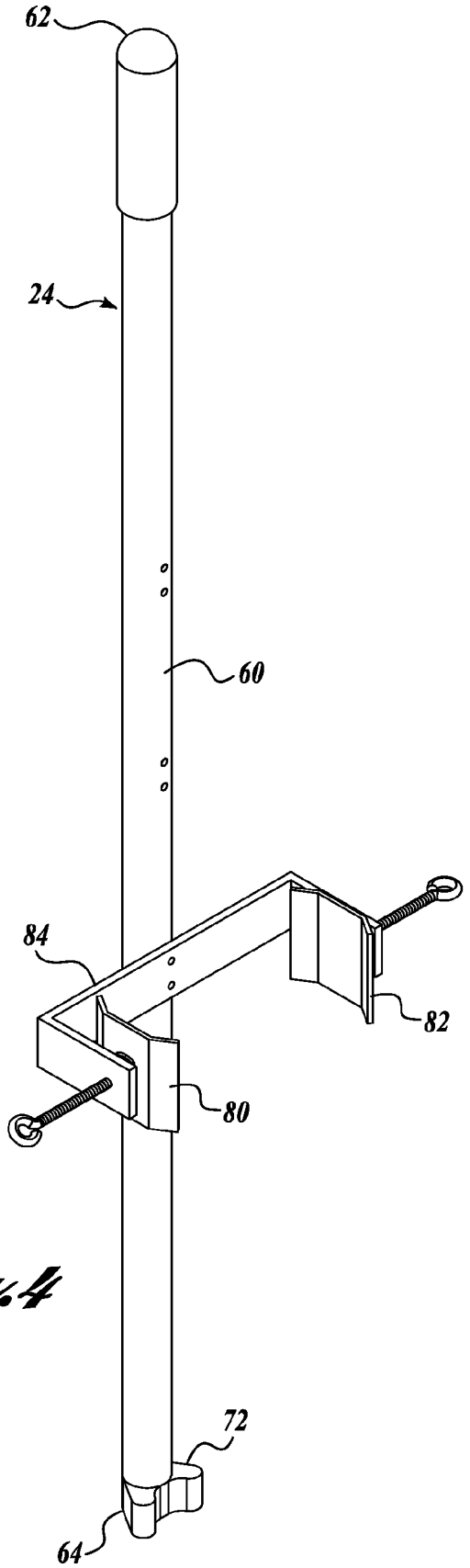
FIGS. 4 and 5 are close-up isometric views of a reel portion in the chalk line assembly of FIG. 1.

Referring to FIGS. 1 and 4, the chalk line reel 70 is adjustably attached to the reel portion 60 by adjustable attachment brackets 80 and 82. The adjustable attachment brackets 80 and 82 are adjustable by a screw coupling interface with support portion 84. However, the coupling interface may be a spring biased interface or any other adjustable coupling interface. The adjustable attachment brackets 80 and 82 allow for various chalk line reels of varying size and design to be used in the chalk line assembly 20.

In other embodiments of the present disclosure, the chalk line reel may be fixed on the reel portion or otherwise incorporated into the reel portion (see, e.g., FIGS. 10A-12).

Figure 5:
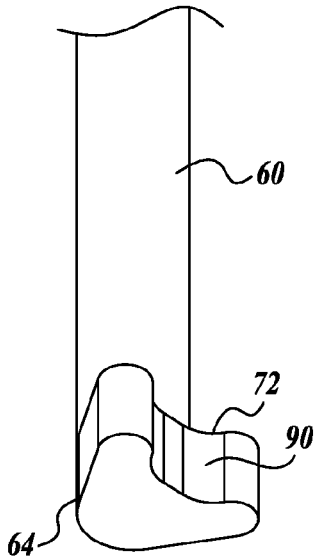

Referring to FIG. 5, the reel portion 60 further includes a line trapper 72 at the second end 64 of the reel portion 60. The line trapper 72 may include an optional groove 90 that allows the line 26 to travel from and retract into the chalk line reel 70, but maintains the line 26 at the second end 64 of the reel portion 60. The line trapper 72 may also include an optional bumper at the second end 64 of the reel portion 60 for soft engagement with a surface to be marked.

A method of using the chalk line assembly 20 will now be described. The method may begin with the first and second marking portions 22 and 24 adjacent one another and the chalk line 26 wound up in the chalk line box 70 (see FIG. 1). First and second users set the first and second marking portions 22 and 24 at first and second points in any setting order, reeling out the chalk line 26 as they set the points. In that regard, the first and second users walk apart from each other, extending the chalk line 26 between the respective first and second marking portions 22 and 24 to a desired distance.

In one method of use, a first user holds the second marking portion 24 (including reel portion 60 and chalk line box 70) for setting a first chalk line point. In the illustrated embodiment, the reel portion 60 has a chalk line reel 70 attached to it, from which a chalk line 26 extends from the first marking portion 22 to the second marking portion 24. The chalk line 26 may extend outwardly from the chalk line reel 70 or may be fed to the second end 64 of the reel portion 60 by an optional line trapper 72. In the illustrated embodiment, in setting the first chalk line point, the first user traps the chalk line 26 in the line trapper 72 at the second end of the reel portion 60 (see FIG. 5).

Figure 6:
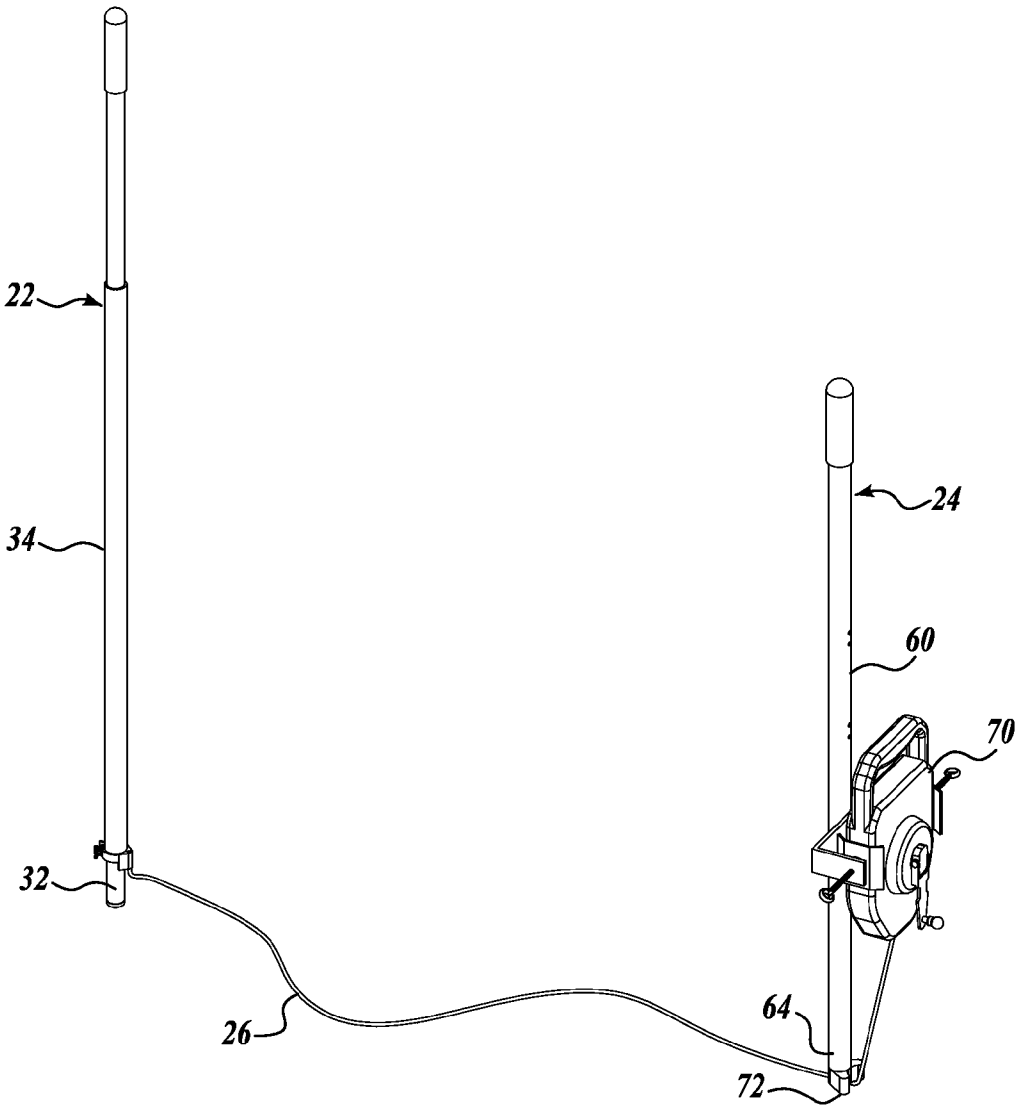
FIGS. 6-9 are a series of views of a first end of the chalk line extending from the reel portion to the sliding assembly, showing the process of snapping a chalk line using the sliding assembly.

Referring now to FIG. 6, the second user then sets the second chalk line point by setting first marking portion 22, including the sliding assembly 30 having a fixed portion 32 and a sliding portion 34 with the sliding portion 34 in a first "up" position (see FIG. 7). The second user aligns the second end 42 of the fixed portion 32 on the ground or marking surface. With the chalk line 26 at its desired length and trapped on one end by the line trapper 72 of the reel portion 60, the second user moves the first marking portion 22 back until tension is achieved in the chalk line 26 between the two marking points.

When both the first and second marking portions 22 and 24 are fixed in position with tension on the chalk line 26 (see FIG. 7), the second user slides the sliding portion 34 of the first marking portion 22 to the ground to a second down position (see FIG. 8) to snap a chalk line 26 between the second end 64 of the reel portion 60 and the second end 42 of the fixed portion 32. The result is a chalked straight line L between the two points, achieved by both users standing in an upright standing position.

After the chalk line is snapped, the second user may slide the sliding portion 34 of the sliding assembly 30 back up to the first "up" position (see FIG. 9). The first and second users can then walk to new first and second marking positions.

In a second method of use, the chalk line points may be set in the reverse order. A first user holds the first marking portion 22 for setting a first chalk line point. A second user holds the second marking portion 24 for setting a second chalk line point. When both the first and second marking portions 22 and 24 are fixed in position with tension on the chalk line 26, the chalk line 26 can be snapped.

Now referring to FIGS. 10A-15, chalk line assemblies 120, 220, 320, and 410 in accordance with other embodiments of the present disclosure will be described in more detail. The chalk line assemblies 120, 220, 320, and 420 of FIGS. 10A and 10B, FIGS. 11 and 12, FIGS. 13 and 14, and FIGS. 15-17 respectively, are substantially identical in materials and operation as the previously described embodiment, except for differences regarding the attachment of the chalk line reel to the reel portion, which will be described in greater detail below. For clarity in the ensuing descriptions, numeral references of like elements of the chalk line assembly 20 are similar, but are in the 100 series for the illustrated embodiment of FIGS. 10A and 10B, in the 200 series for the illustrated embodiment of FIGS. 11 and 12, in the 300 series for the illustrated embodiment of FIGS. 13 and 14, and in the 400 series for the illustrated embodiment of FIGS. 15-17.

Figure 10A:
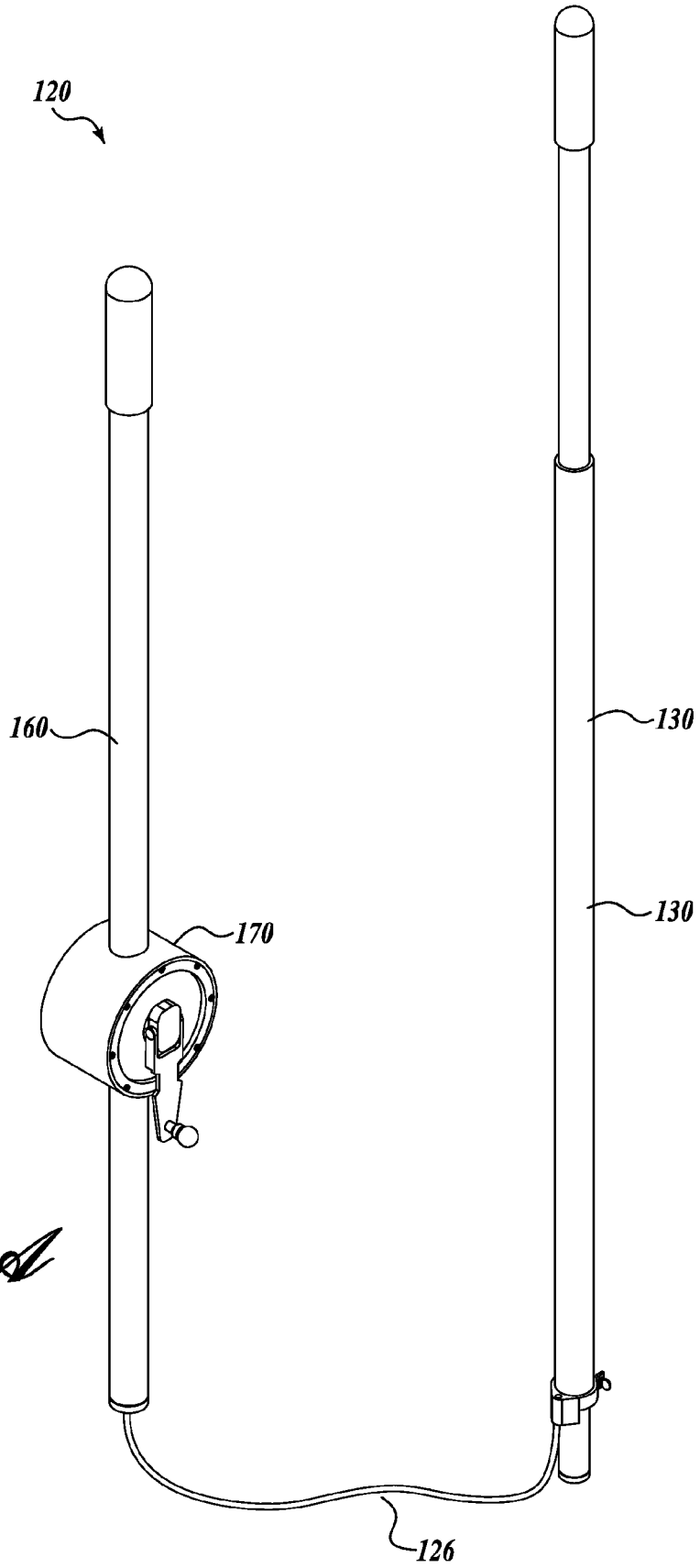
FIGS. 10A-17 are line drawings of chalk line assemblies in accordance with other embodiments of the present disclosure.
Figure 10B:
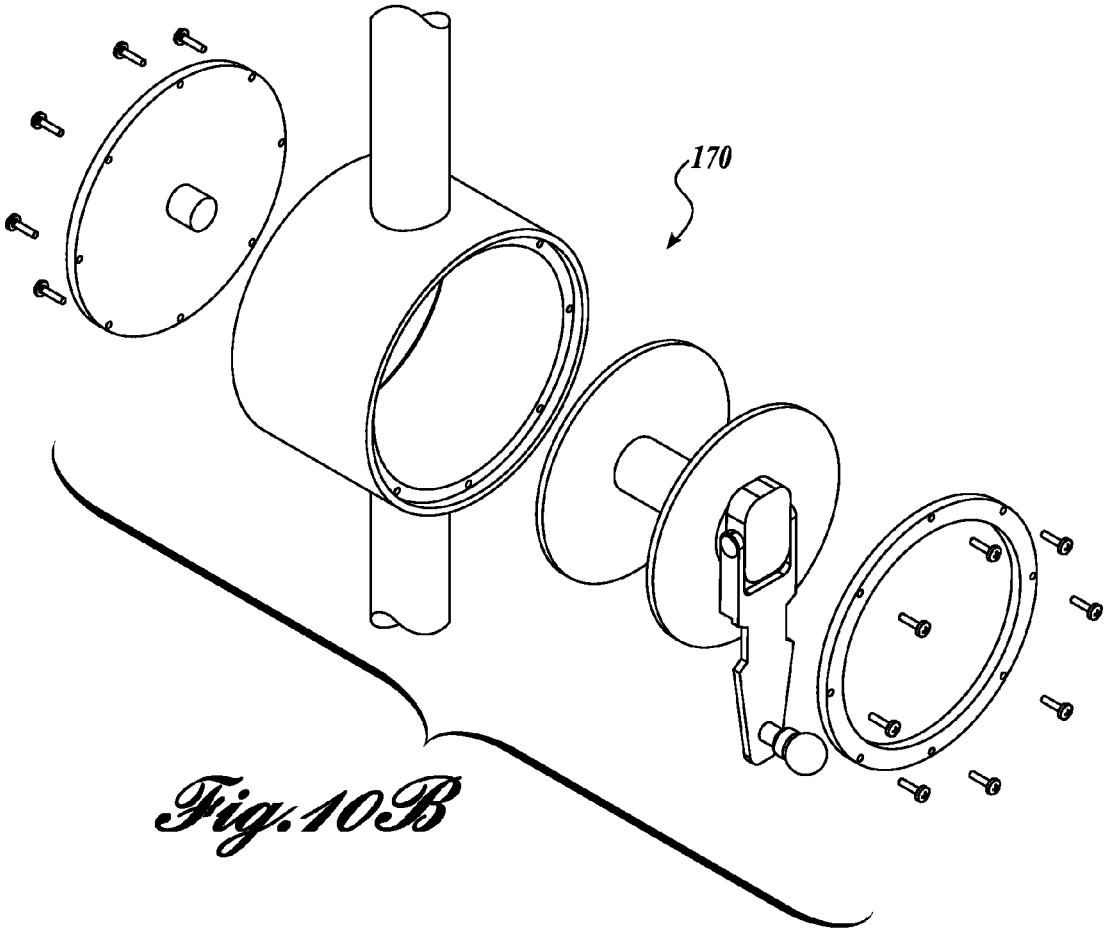
Figure 11:
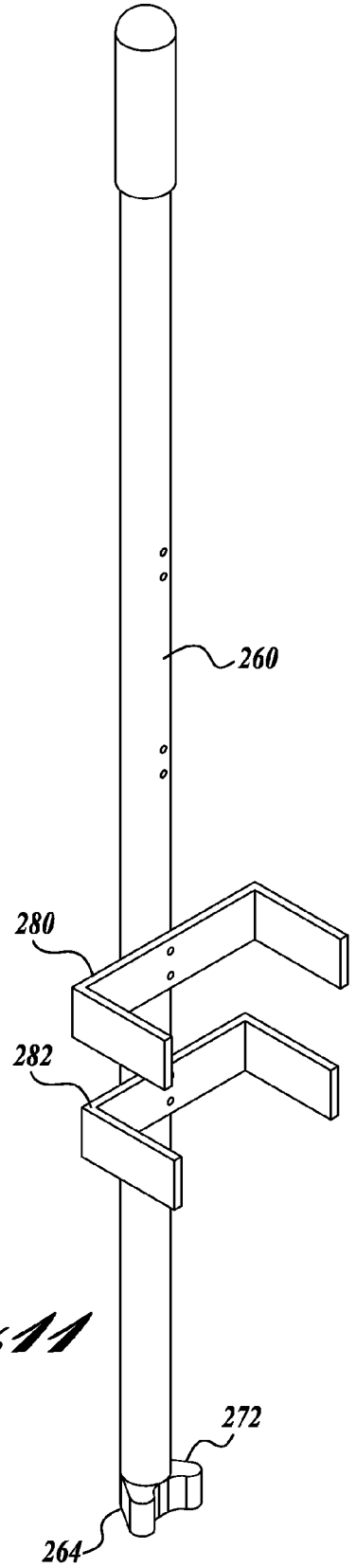
Figure 12:
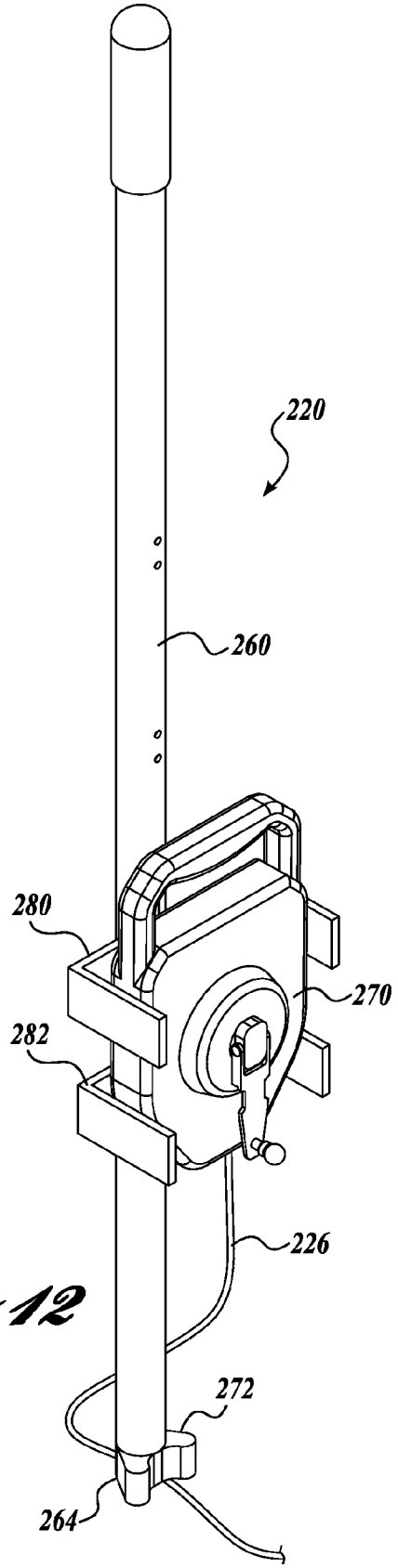

Referring to FIGS. 10A and 10B, the chalk line assembly 120 includes a chalk line reel 170 incorporated into the reel portion 160. In that regard, chalk can be refilled directly into the reel portion 160. An exploded view of the chalk line reel 170 is provided in FIG. 10B Referring to FIGS. 11 and 12, the chalk line assembly 220 includes a chalk line reel 270 configured to be fixedly attached to the reel portion 260 using fixed brackets 280 and 282. The chalk line reel 270 may attach to the bracket through the use of fasteners, through an interference fit, or through any other means for attachment.

Figure 13:
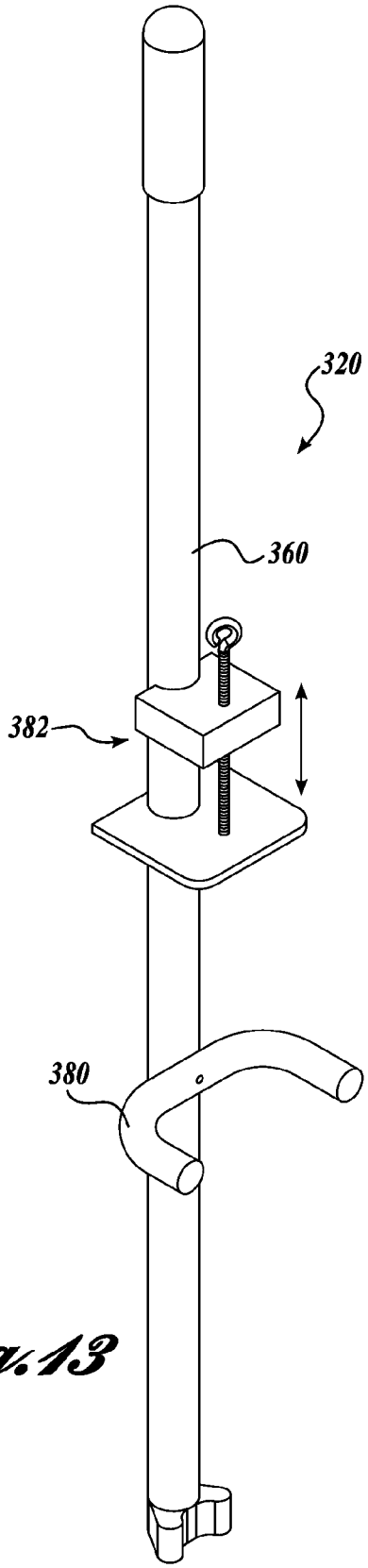
Figure 14:
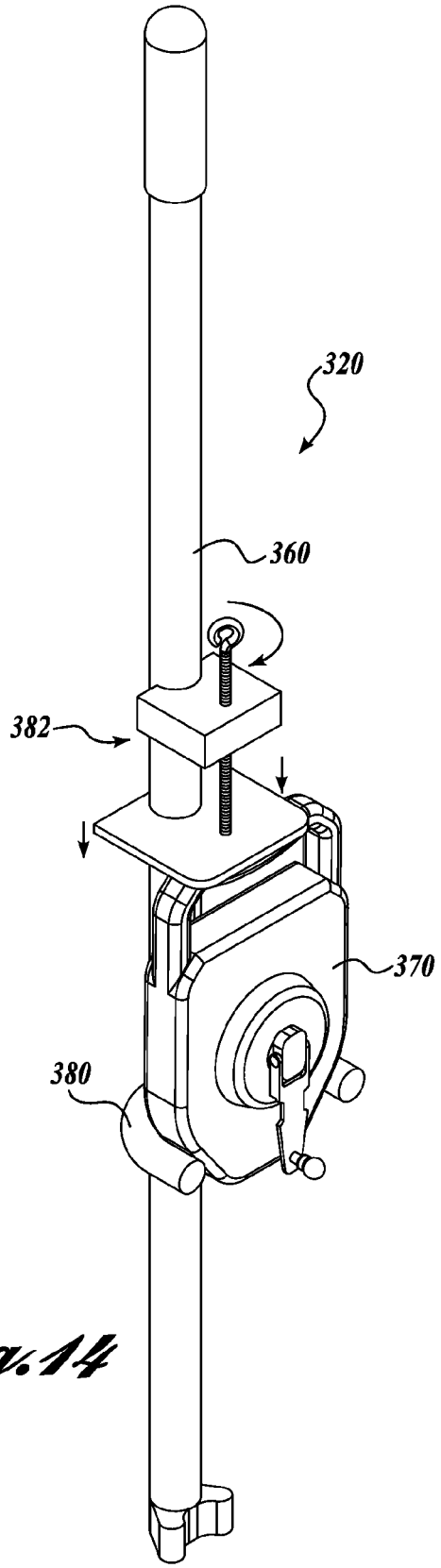

Referring to FIGS. 13 and 14, the chalk line assembly 320 includes a receiving mechanism for a chalk line reel 370. The receiving mechanism includes a support portion 380 and an adjustable securing portion 382. The securing portion 382 may include a spring or a screw to securing the chalk line reel to the reel portion 360. The receiving mechanism allows for various chalk line reels of varying size and design to be used in the chalk line assembly 320.

Figure 15:
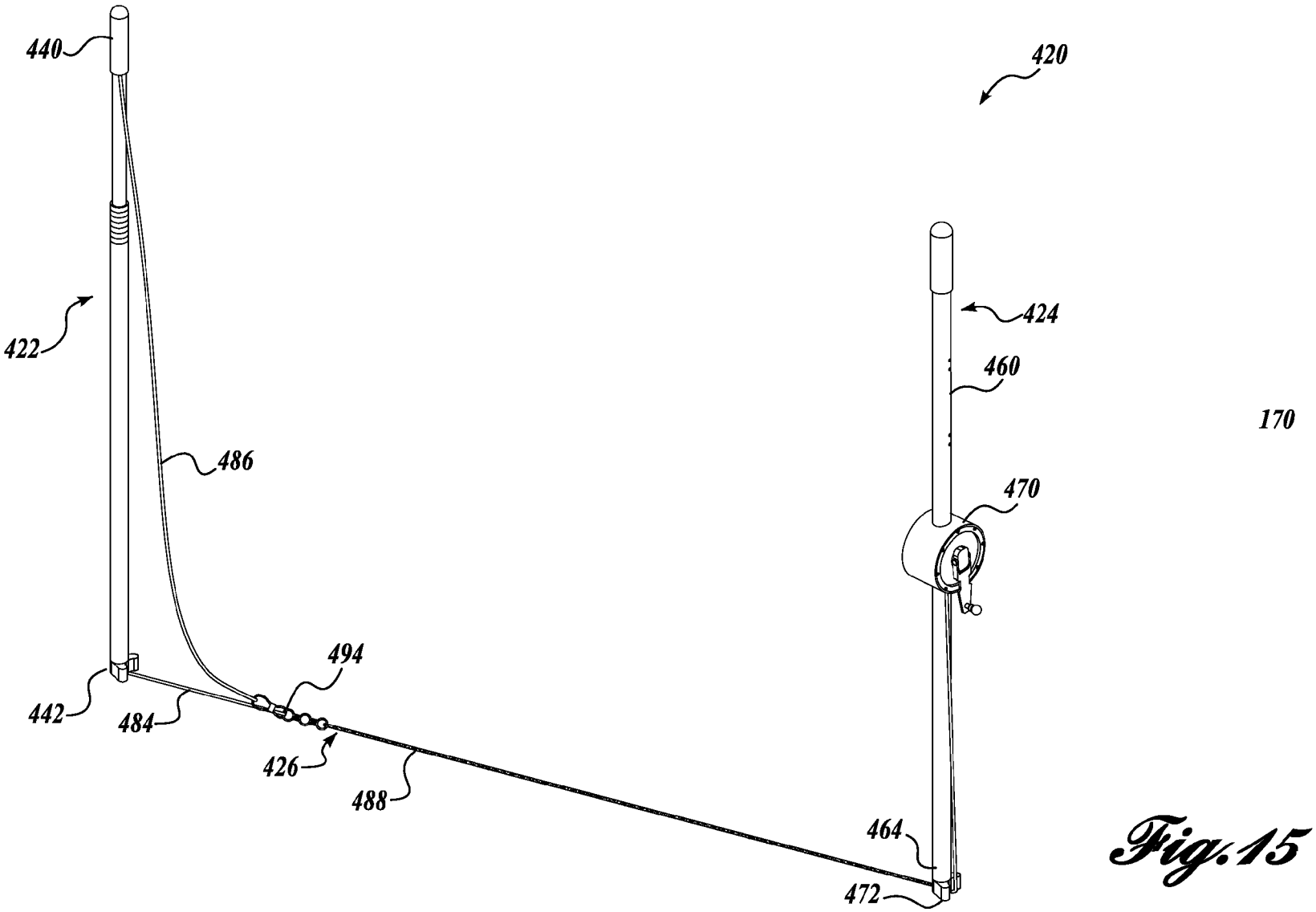
Figure 16:
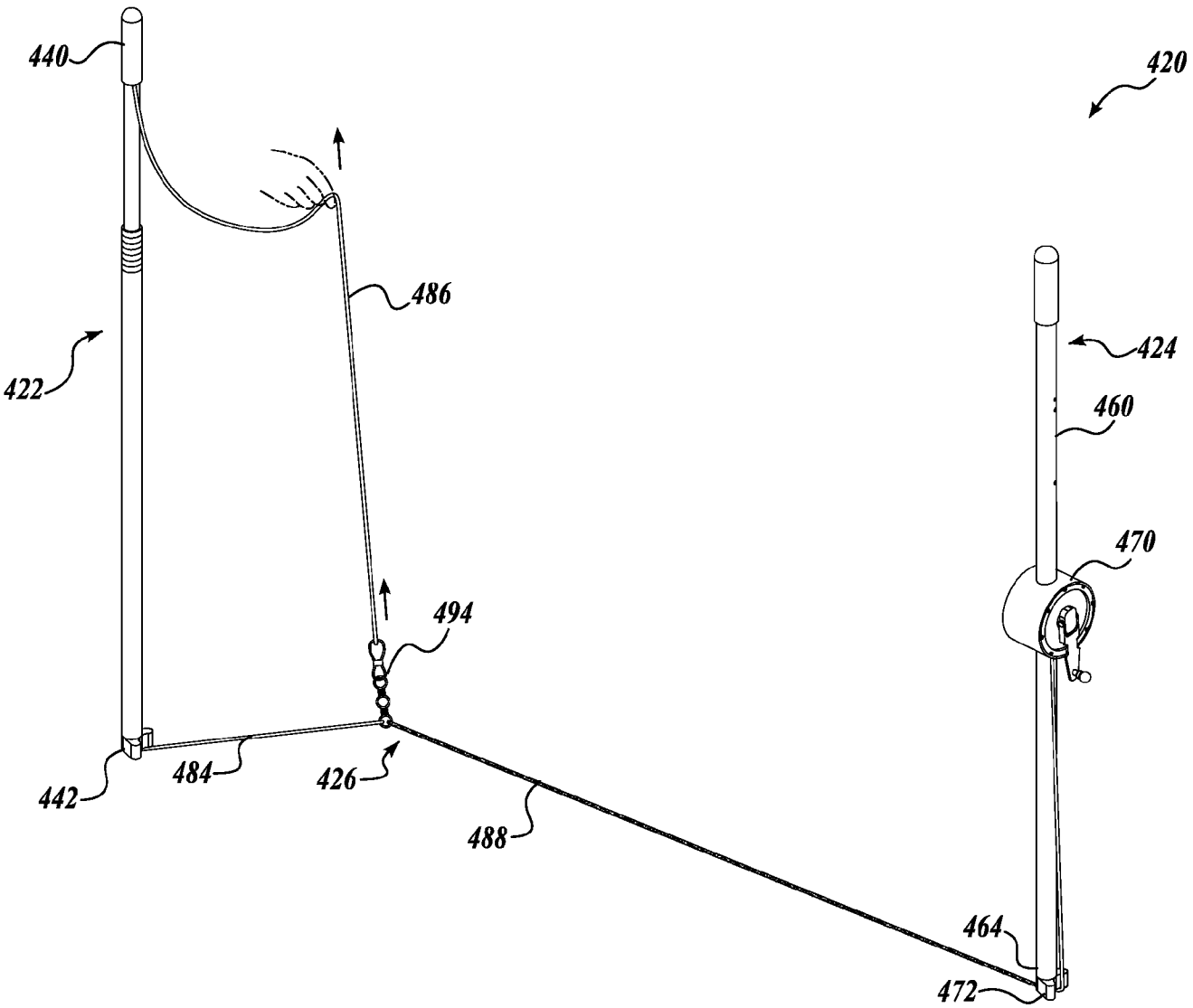
Figure 17:
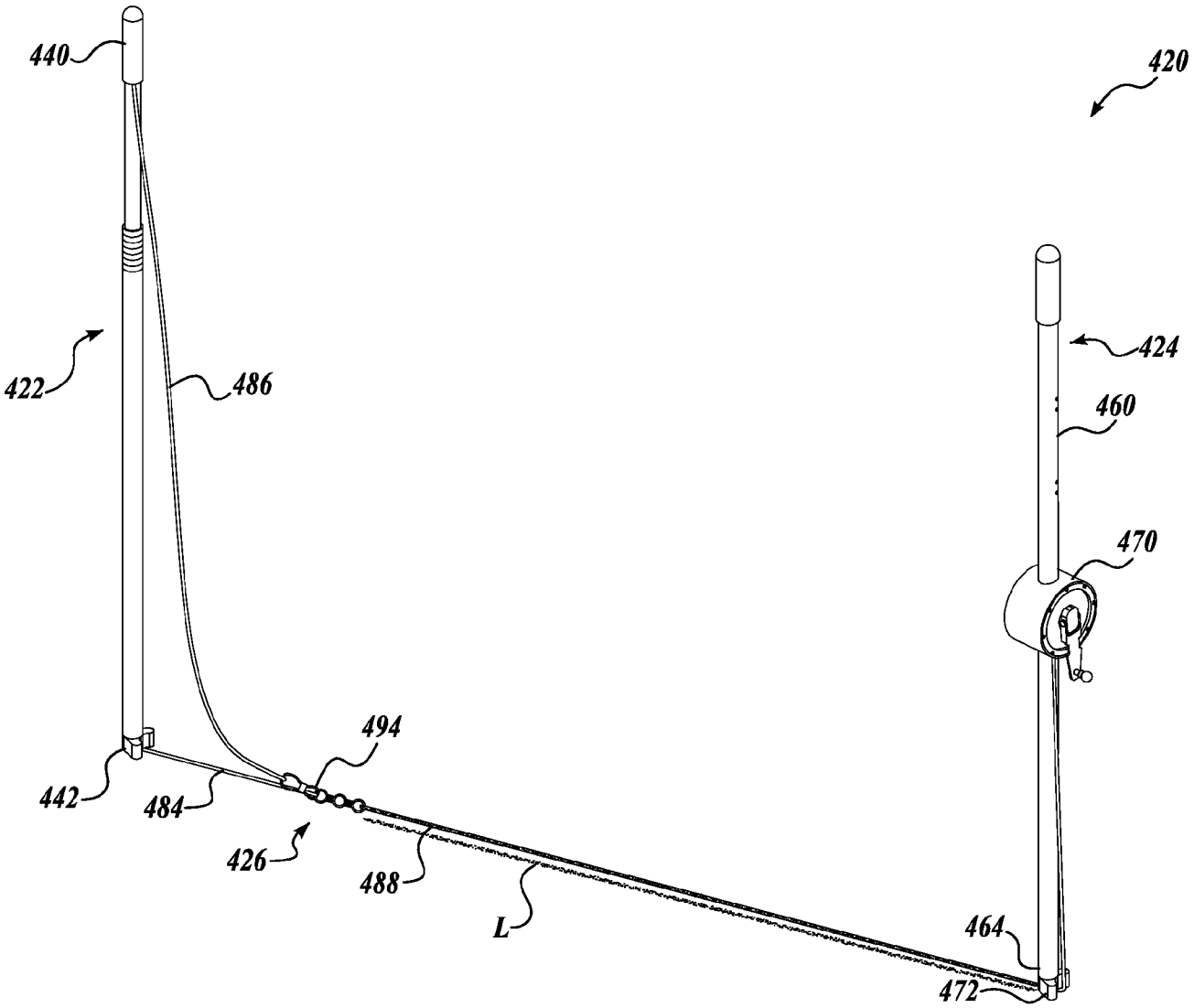

In the illustrated embodiment of FIGS. 15-17, the chalk line assembly 420 includes a first marking portion 422 that does not include a sliding portion and is only an anchor portion. In the illustrated embodiment, the anchor portion 436 includes a dynamic chalk line 426 for marking a chalked straight line L (see FIG. 17). The chalk line 426 is coupled to a vertical line 486 attached at or near the top end 440 of the anchor portion 422 and a horizontal line 484 attached at or near the bottom end 442 of the anchor portion 422. The chalk line 426 extends from the chalk reel 470 on the second marking portion 424 (reel portion 460) and is trapped by the line trapper 472 at the second end of the reel portion 460. The three lines 484, 486, and 488 are coupled by coupling 494. The part of the chalk line 426 extending from the line trapper 472 to the coupling 494 is the marking chalking portion 488 of the chalk line 426.

Coupling 494 is a swivel device that allows the vertical line 486 and the horizontal line 484 to freely swivel or pivot relative to the chalking portion 488 of the chalk line 426. In the illustrated embodiment, the coupling 494 includes a plurality of linked loops configured to keep the chalk line from twisting and kinking. In other embodiments, the coupling 494 may be another swivel device or pivoting link.

In one method of use, a first user holds the second marking portion 424 (including reel portion 460 and chalk line box 470) for setting a first chalk line point. In the illustrated embodiment, the reel portion 460 has a chalk line reel 470 attached to it, from which a chalk line 426 extends from the anchor portion 422 to the second marking portion 424. The chalk line 426 may extend outwardly from the chalk line reel 470 or may be fed to the second end 464 of the reel portion 460 by an optional line trapper 472. In the illustrated embodiment, in setting the first chalk line point, the first user traps the chalk line 426 in the line trapper 472 at the second end of the reel portion 460 (see FIG. 15).

Still referring to FIG. 15, the second user then sets the second chalk line point by setting anchor portion 422. The second user aligns the second end 442 of the anchor portion 422 on the ground or marking surface. When the anchor and reel portions 422 and 424 are set, there is tension on all three lines: chalk line 426, vertical line 486, and horizontal line 484. Referring to FIG. 16, with the chalk line 426 at its desired length and trapped on one end by the line trapper 472 of the reel portion 460, the second user pulls up and releases the vertical line 486 attached at or near the top end 440 of the anchor portion 422. Such action causes the marking chalk line portion 488 of the chalk line 426 to chalk straight line L extending along at least a portion of the distance between two points on the ground or marking surface as set by the anchor portion 422 and the reel portion 424, which is achieved by both users standing in an upright standing position.

After the chalk line is snapped, the first and second users can then walk to new first and second marking positions.

In a second method of use, the chalk line points may be set in the reverse order. A first user holds the anchor portion 422 for setting a first chalk line point. A second user holds the reel portion 424 for setting a second chalk line point. When both the anchor and reel portions 422 and 424 are fixed in position with tension on the chalk line 426, the chalk line 426 can be snapped.

An advantageous effect of all of the embodiments described herein is that both users of the chalk line assembly can lay a precise chalk line on a ground level surface while standing in an upright standing position, and without bending to their bodies to have their hands at the ground level surface.

One advantageous effect of the illustrated embodiment of FIGS. 15-17 is the chalk line assembly 420 allows for snapping of more precise chalk lines having a reduced chalk amount compared to previously designed systems. The tension provided by the concert of three lines 484, 486, and 488 working together allows for a quicker and more precise snap than the tension of one line 26 in a standard chalk box and the tension provided by a user sliding the sliding assembly in the embodiment of FIGS. 1-9. Such precision reduced chalk dust and allows for more efficient chalk line work. As a non-limiting example, a single chalking of the chalk line from the chalk reel 470 allows for more chalk line usage before requiring re-chalking of the chalk line. In one non-limiting example, a single chalking of the chalk line in the embodiment of FIGS. 15-17 will snap 2 to 3 times more chalk lines than the single chalking of a chalk line in the embodiment of FIGS. 1-9.

The principles, representative embodiments, and modes of operation of the present disclosure have been described in the foregoing description. However, aspects of the present disclosure which are intended to be protected are not to be construed as limited to the particular embodiments disclosed. Further, the embodiments described herein are to be regarded as illustrative rather than restrictive. It will be appreciated that variations and changes may be made by others, and equivalents employed, without departing from the spirit of the present disclosure. Accordingly, it is expressly intended that all such variations, changes, and equivalents fall within the spirit and scope of the present disclosure, as claimed.

The embodiments of the invention in which an exclusive property or privilege is claimed are defined as follows:

1. A chalk line assembly, comprising:

(a) a first marking portion for setting a first point, wherein the first marking portion has a height;

(b) a second marking portion for setting a second point, wherein the second marking portion has a height;

(c) a chalk line for marking chalked straight line on a surface, the chalk line having first and second ends and a length extending for at least a portion of the distance between the first and second marking portions; and (d) a horizontal line having a first end and a second end and a vertical line having a first end and a second end, wherein the first ends of the horizontal line and the vertical line are coupled to the first end of the chalk line, and the second ends of the horizontal line and the vertical line are connected to the first marking portion.

2. The chalk line assembly of claim 1, wherein the first marking portion includes a sliding assembly.

3. The chalk line assembly of claim 2, wherein the sliding assembly includes a fixed portion having a first end and a second end and a sliding portion having a first end and a second end, the sliding portion in sliding relationship with the fixed portion.

4. The chalk line assembly of claim 3, wherein the fixed portion includes an anchor portion, and wherein the sliding portion is a slide pole surrounding the anchor portion.

5. The chalk line assembly of claim 3, wherein the fixed portion includes a spike at the second end of the fixed portion.

6. The chalk line assembly of claim 3, wherein the first end of the chalk line is attached to the first end of the sliding portion of the sliding assembly.

7. The chalk line assembly of claim 6, wherein the second end of the chalk line is attached at or near the first end of the reel portion.

8. The chalk line assembly of claim 6, wherein a chalk line reel is coupled to the reel portion.

9. The chalk line assembly of claim 6, wherein a chalk line reel is releasably coupled to the reel portion.

10. The chalk line assembly of claim 6, wherein a chalk line reel is a part of the reel portion.

11. The chalk line assembly of claim 1, wherein the second marking portion includes a reel portion having a first end and a second end.

12. The chalk line assembly of claim 1, wherein the chalk line is a retractable chalk line.

13. The chalk line assembly of claim 1, wherein the chalk line retracts in a chalk line reel.

14. The chalk line assembly of claim 1, wherein a chalk line reel is coupled to a receiving portion on the second marking portion.

15. The chalk line assembly of claim 1, wherein the anchor portion has a first end and a second end.

16. The chalk line assembly of claim 15, wherein the second end of the horizontal line is coupled to the second end of the anchor portion.

17. The chalk line assembly of claim 15, wherein the second end of the vertical line is coupled to the first end of the anchor portion.

18. The chalk line assembly of claim 1, wherein the coupling between the first ends of the horizontal line and the vertical line and the first end of the chalk line includes a pivoting link.

19. A chalk line assembly, comprising:

(a) an anchor portion for setting a first point, wherein the anchor portion has a height of at least 4 feet, the anchor portion including a horizontal line having a first end and a second end and a vertical line having a first end and a second end, the first ends of the horizontal line and the vertical line are coupled to the first end of the chalk line, and the second ends of the horizontal line and the vertical line are connected to the anchor portion;

(b) a reel portion for setting a second point, the reel portion having a first end and a second end, wherein the reel portion has a height of at least 4 feet; and (c) a chalk line having first and second ends and a length extending between for at least a portion of the distance between the first marking portion and the reel portion, wherein the chalk line is retractably coupled to the reel portion.

20. A method of marking a chalk line, the method comprising:

(a) reeling a length of a chalk line from a reel portion, wherein the chalk line has first and second ends and extends for at least a portion of the distance between an anchor portion and the reel portion, wherein the anchor portion includes a horizontal line having a first end and a second end and a vertical line having a first end and a second end, the first ends of the horizontal line and the vertical line are coupled to the first end of the chalk line, and the second ends of the horizontal line and the vertical line are connected to the anchor portion;

(b) setting a first point for the chalk line using one of the reel portion and the anchor portion;

(c) setting a second point for the chalk line using the other of the reel portion and the anchor portion; and (d) snapping the chalk line by pulling the vertical line upward and releasing the vertical line.

21. A chalk line assembly, comprising:

(a) a first marking portion for setting a first point, wherein the first marking portion has a height;

(b) a second marking portion for setting a second point, wherein the second marking portion has a height;

(c) a chalk line for marking chalked straight line on a surface, the chalk line having first and second ends and a length extending for at least a portion of the distance between the first and second marking portions; and (d) a vertical line having a first end and a second end, the first end of the vertical line coupled to the chalk line, and the second end of the vertical line connected to the first marking portion.

22. A method of marking a chalk line, the method comprising:

(a) reeling a length of a chalk line from a reel portion, wherein the chalk line has first and second ends and extends for at least a portion of the distance between an anchor portion and the reel portion, wherein the anchor portion includes a vertical line having a first end and a second end, the first end of the vertical line is coupled to the chalk line, and the second end of the vertical line is connected to the anchor portion;

(b) setting a first point for the chalk line using one of the reel portion and the anchor portion;

(c) setting a second point for the chalk line using the other of the reel portion and the anchor portion; and (d) snapping the chalk line by pulling the vertical line upward and releasing the vertical line.

* * * * *